US007187856B2

(12) United States Patent
Atkins

(10) Patent No.: US 7,187,856 B2
(45) Date of Patent: Mar. 6, 2007

(54) COMPACT INTEGRATED FORCED AIR DRYING SYSTEM

(75) Inventor: Mark R. Atkins, St. Charles, IL (US)

(73) Assignee: FlexAir, Inc., Wasco, IL (US)

( * ) Notice: Subject to any disclaimer, the term of this patent is extended or adjusted under 35 U.S.C. 154(b) by 244 days.

(21) Appl. No.: 09/939,144

(22) Filed: Aug. 27, 2001

(65) Prior Publication Data

US 2004/0033069 A1 Feb. 19, 2004

(51) Int. Cl.
*F24H 1/10* (2006.01)

(52) U.S. Cl. ..... 392/484; 392/379; 34/226

(58) Field of Classification Search ..... 392/484, 392/379, 416, 417; 34/224, 215, 216, 226, 34/232, 199
See application file for complete search history.

(56) References Cited

U.S. PATENT DOCUMENTS

| | | | | |
|---|---|---|---|---|
| 1,479,819 | A | | 1/1924 | Kluever |
| 1,724,644 | A | | 8/1929 | De Long |
| 1,768,498 | A | | 6/1930 | Willsea |
| 1,955,055 | A | | 4/1934 | Date |
| 2,041,238 | A | | 5/1936 | Fickes |
| 2,298,803 | A | | 10/1942 | Morris |
| 2,420,739 | A | | 5/1947 | Dorsch |
| 2,578,633 | A | | 12/1951 | Mauffre |
| 2,627,667 | A | | 2/1953 | Gillis |
| 2,731,732 | A | | 1/1956 | Harris, Jr. et al. |
| 2,831,951 | A | | 4/1958 | Desloge |
| 3,970,822 | A | | 7/1976 | Wrob |
| 4,207,457 | A | | 6/1980 | Haglund et al. |
| 4,233,901 | A | | 11/1980 | Mallinson |
| 4,340,893 | A | | 7/1982 | Ort |
| 4,386,650 | A | | 6/1983 | Moen |
| 4,504,220 | A | | 3/1985 | Sunakawa et al. |
| 4,535,222 | A | | 8/1985 | Moen |
| 4,567,673 | A | | 2/1986 | Bohnensieker |
| 4,756,091 | A | * | 7/1988 | Van Denend ..... 34/266 |
| 5,086,700 | A | | 2/1992 | Van Den Berg |
| 5,113,931 | A | | 5/1992 | Oswalt et al. |
| 5,212,763 | A | | 5/1993 | Arold et al. |
| 5,303,325 | A | | 4/1994 | Pasternak et al. |
| 5,370,047 | A | | 12/1994 | Compton |
| 5,502,788 | A | * | 3/1996 | Platsch ..... 392/424 |
| 5,765,294 | A | | 6/1998 | Puschnerat |
| RE36,083 | E | | 2/1999 | Spiegel et al. |
| 5,881,647 | A | | 3/1999 | Siler et al. |
| 5,937,535 | A | * | 8/1999 | Hoffman et al. ..... 34/78 |
| 5,937,761 | A | | 8/1999 | Buschmann et al. |
| 6,176,184 | B1 | | 1/2001 | Mudry |
| 6,601,318 | B1 | * | 8/2003 | Platsch ..... 34/629 |

* cited by examiner

*Primary Examiner*—Thor S. Campbell
(74) *Attorney, Agent, or Firm*—The Law Office of Randell T. Erickson, P.C.

(57) ABSTRACT

A fully integrated drying or heating system for the printing, coating, or painting industries that utilizes forced air and electrical heaters. The method for heating the forced air incorporates a solid cartridge heater within a specially designed air distribution system. The nature of this invention allows the operating controls and all the components of the air distribution system and air heating system to be fully integrated into a singular compact package, thus requiring only a pressurized air source and electrical power means to be supplied to the unit.

19 Claims, 11 Drawing Sheets

COMPACT INTEGRATED FORCED AIR DRYING SYSTEM

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to evaporative drying systems, hereinafter called dryers, more particularly to dryers that are used to dry solvent based or water based inks, paints or coatings.

Traditional dryers dry by projecting heated air and/or radiating heat energy. The most common form of a projected air dryer delivers lightly pressurized preheated air into a distribution plenum, which is then dispersed through a series of slots or circular orifices to the medium being dried. These types of dryers typically rely on large volumes of air to adequately dry, thus consuming substantial amounts of energy and requiring extensive air handling equipment.

In some of the more recent forced hot air dryers, compressed air is preheated prior to entering the distribution plenum(s). The preheating is typically accomplished by the use of a separate heat plant device such as the common triple pass or inline air heater. Using a heat plant that is separated from the air distribution system introduces inefficiencies of operation; additional equipment and manufacturing costs; and additional equipment. The added equipment can also make the dryer prohibitively large in size for some applications that have limited available space.

Current dryer systems have their operating controls located remotely from the distribution plenum(s), which increases the complexity of the controls system and the associated costs for the manufacturing and installation of the entire system.

BRIEF SUMMARY OF THE INVENTION

A forced hot air dryer for the printing, painting and coating industries that fully integrates the air handling equipment, heat plant, air flow control and air temperature control into a single compact package. The preferred embodiment utilizes a solid cartridge heater within a specially designed air distribution system to raise the temperature of the forced air just before it discharges. The invention greatly simplifies the complexity, reduces space requirements, and maximizes the energy efficiencies over current drying systems.

BRIEF DESCRIPTION OF THE SEVERAL VIEWS OF THE DRAWINGS

The invention will be explained in conjunction with illustrative embodiments shown in the accompanying drawings, in which.

DESCRIPTION OF THE PREFERRED EMBODIMENTS

Printing, coating, and painting lines have various configurations and methods of operation. Configurations vary in the number of printing decks, method of conveying the product, line speeds, etc., which will all depend on the type of product, process, and application. Products can be conveyed in several different ways such as in the form of a continuous web, sheet, or simply moving the product through via a conveyor.

Figure 1:
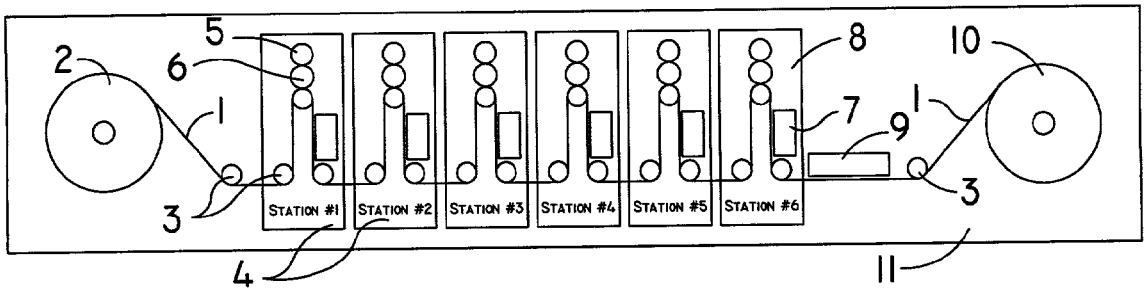
FIG. 1 is a schematic illustration of a narrow web in-line printing press with multiple color stations.

More particular the flexographic press, illustrated in FIG. 1 is a conventional and well-known type of narrow web printing and/or coating press, hereinafter called narrow web press (11). The narrow web press (11) typically prints and/or applies coating on a continuous web (1), hereinafter called web, whereupon the freshly applied inks or coating need to be dried. The web (1) enters the narrow web press from the unwind station (2) and then travels through a series of idler rollers (3) in a serpentine path while passing through multiple print stations (4).

Figure 2:
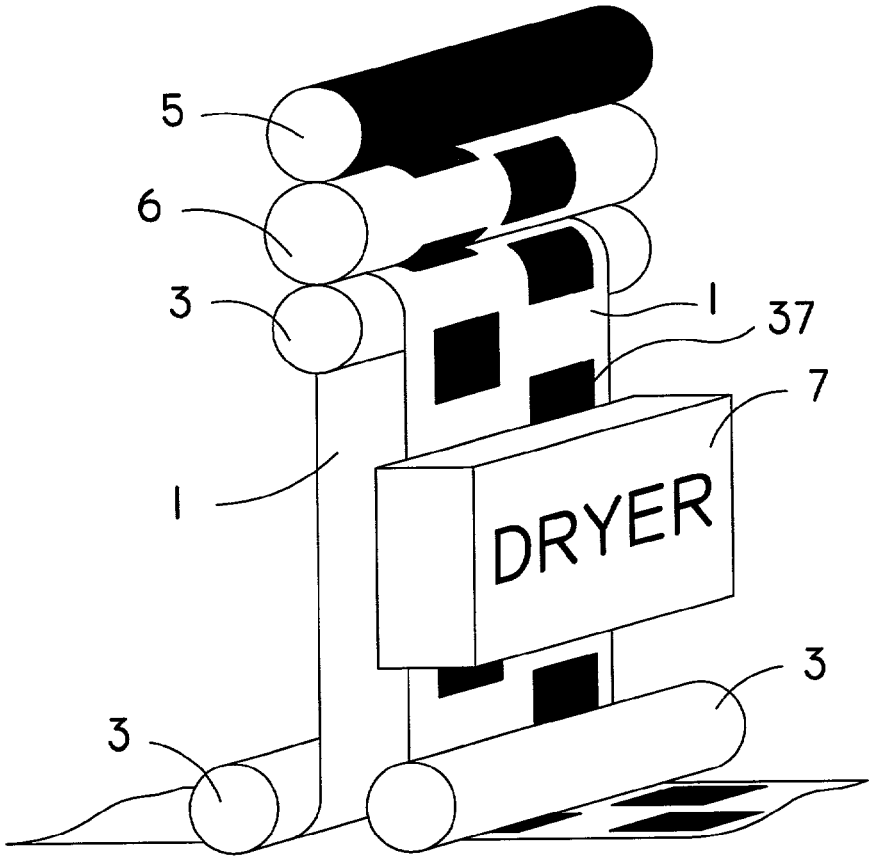
FIG. 2 is a schematic illustration detailing a single color station of the narrow web in-line printing press of FIG. 1.

FIG. 2 details an individual printing station of FIG. 1. A print station (4) consists of a transfer roll (5) and plate roll (6) that apply a printed image (37) or coating onto the web as it passes through the print station (4). After being applied to the web, the printed image (37) or coating moves past the transfer roll and plate roll area, and subsequently enters a drying zone (7) where it will be partially or completely dried before entering the next printing station.

As the printed or coated web exits the last printing station (8), depending on the product, process, and application, a final drying stage (9) may be required. The final drying stage (9) may be comprised of a single or multiple dryers. The final drying stage will evaporate the residual traces of ink solvents from the ink, and/or cure the already substantially dried inks prior to being rewound in the narrow web press rewinder (10).

The practice of configuring the combination of the web, unwind, print stations, dryers, and rewind is well known. The particular configuration of these fundamental elements of a printing press can vary greatly between printing technologies and process applications.

The nature of this invention includes the novel method of simplifying and compacting a heated forced air dryer system. This is specifically accomplished by the integration of a dedicated solid cartridge heater into a specially designed air distribution system.

It is the object of this invention to create a means of efficiently transferring heat energy from the solid cartridge heater to the air as the air passes through the air distribution system. It is also the object of this invention to substantially equalize the temperature of the heated air that is projected out of the dryer, across the dryer width.

A solid cartridge heater is used to heat the air in the drying system. The solid cartridge heater is a commercially available device that is typically used to heat solid metal structures for plastic or metal manufacturing processes, and to heat liquids in tanks or pipes. The heating element is an electrical resistance heater that is ultimately powered by a voltage source. Various size solid cartridge heaters can be used that may vary in diameter, length, power level and mounting depending on the process and application. The preferred solid cartridge heater is of cylindrical geometry of approximately ½ inch cylindrical diameter with the cylindrical length of the solid cartridge heater approximately equal to the dryer width. The solid cartridge heater is well described in U.S. Pat. No. 3,970,822.

To simply pass air over a solid cartridge heater that is housed within a simple shell plenum such as a common cylindrical or square tube will result in non-optimal operating conditions, including inefficient and uneven transfer of heat energy to the air. The inefficiencies originate from the limited surface area of the solid cartridge heater that is exposed to the passing air as well as unrestricted airflow patterns within the simple shell. The inefficient and uneven heat transfer results in localized hot spots within the solid cartridge heater that can severely reduce the operable life of the solid cartridge heater and can produce greatly varying forced air temperatures across the width of the dryer. Hence a specially designed air distribution system is required to overcome the undesirable effects noted above.

Figure 3:
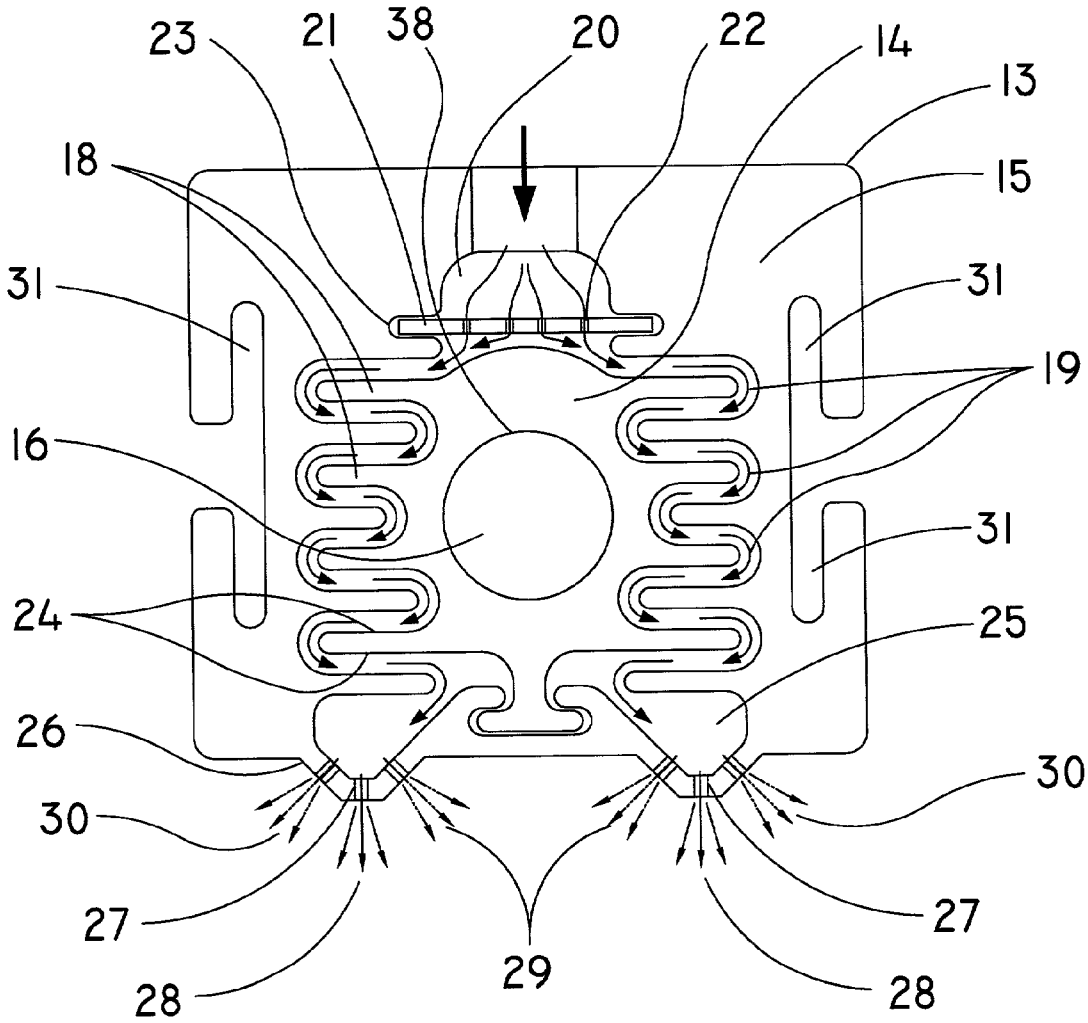
FIG. 3 is an end view of the air distribution system.

The preferred embodiment of this invention incorporates a specially designed air distribution system (13) that is fundamentally comprised of two separate metallic extrusions including the cartridge heat exchanger (14) and air distribution plenum (15) as shown in FIG. 3.

Figure 4:
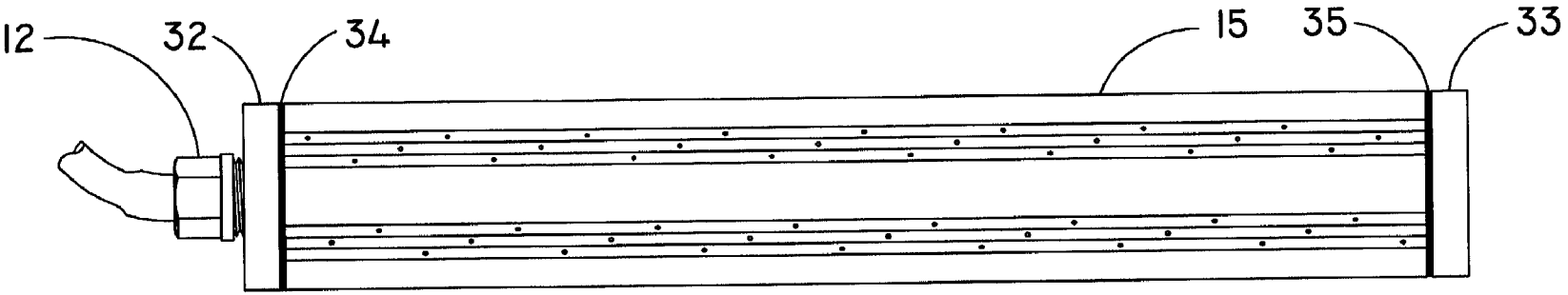
FIG. 4 is a side view of the air distribution system and solid cartridge heater.
Figure 5:
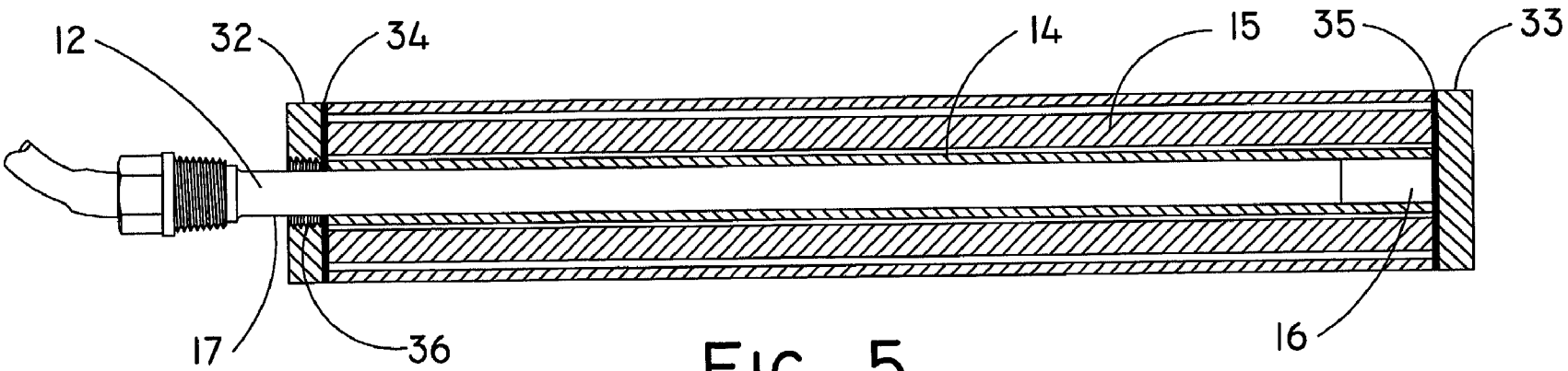
FIG. 5 is a cross-sectional view of FIG. 4 with the solid cartridge heater partially removed.

In the preferred embodiment the cartridge heat exchanger (14) is designed with a cylindrical cavity (16) to accept the solid cartridge heater (12) (See FIGS. 4 and 5). The cylindrical diameter of the cylindrical cavity (16) is carefully controlled to minimize the clearance between the outside surface of the solid cartridge heater (17) (See FIG. 5) and the internal surface of the cylindrical cavity (38) in the cartridge heat exchanger (14) to provide better heat transfer and power density of the solid cartridge heater (12).

The cartridge heat exchanger (14) has multiple heat fins (18) that extend outwardly from the cylindrical cavity (16). The outer geometrical profile of the cartridge heat exchanger (14) compliments the internal geometry of the air distribution plenum (15) to create air passages (19). During operation, the solid cartridge heater (12) is energized by a voltage source. Heat that is generated by the solid cartridge heater is transferred into the cartridge heat exchanger (14) and will migrate outwardly into the heat fins (18). The heat energy is then transferred to the air moving along the heat fin surfaces (24) as the air moves through the air passages (19).

Pressurized air enters the air distribution system (13) through a port that leads into the inlet cavity (20) of the air distribution plenum. Located at the bottom of the inlet cavity (20), a baffle plate (21) is used to redistribute the air in order to provide a uniform and even air flow along the dryer width as the air exits the inlet cavity (20) through the baffle plate (21). The baffle plate (21) is fabricated with a pattern of baffle plate orifices (22) that may vary in diameter, spacing, and arrangement across the width and length of the baffle plate (21) to facilitate the desired even and uniform flow. The baffle plate is located and captured by the baffle plate recesses (23) that are incorporated into the inner geometry of the air distribution plenum (15).

Once the air passes through the baffle plate (21), the air moves along the heat fin surfaces (24) as shown in FIG. 3. As the air passes over the surface of the heat fins (18), the air absorbs the heat energy from the heat fins (18) of the cartridge heat exchanger (14) through thermal convection. The circuitous air passages (19) increase the dwell time that the air is in contact with the heat fins (18) thus increasing the convective heat transfer efficiency.

Engineering thermodynamics states that heat energy output, Q, is directly proportional to the convective heat transfer coefficient, h, the surface area, A, and the temperature differential, $\Delta T$, where $Q=h*A*\Delta T$. By increasing the heat transfer surface area, the temperature differential between the heater and air can be lowered inversely while maintaining a substantially equivalent heat energy output to the air. The lowered temperature differential allows the solid cartridge heater to operate at lower temperatures, thereby increasing the expected life of the solid cartridge heater.

At the end of the circuitous air passages (19) the heated air enters one of two orifice chambers (25) located near the bottom of the air distribution plenum (15). The air distribution plenum walls (26) in the area of the orifice chambers (25) are fashioned to provide a simplified means of manufacturing a series of air release orifices (27) that connect the orifice chamber (25) with the outside of the air distribution system (13). The air release orifices (27) can be manufactured to project the air either directly away (28) from the air distribution system, canted towards the middle (29) of the air distribution system or outwardly from the middle (30) of the air distribution system. In the preferred embodiment shown in FIG. 3, the canted surfaces are constructed at 45 degrees to the central axis of the air distribution system (13).

The air release orifices (27) may vary in diameter, spacing, and arrangement across the width and length of the air distribution system (13), depending on the process or application. The air release orifices (27) are typically 1 millimeter in diameter or less.

Solid cartridge heaters are commercially available with variable power densities along the axial length of the solid cartridge heater as well described in U.S. Pat. No. 3,970,822. The variable power densities can be used to counteract hot or cold spots resulting from uneven flow patterns past the solid cartridge heater. The variable power densities can also be used to deliberately create heated and unheated regions along the length of the solid cartridge heater. This allows the dryer system to be very versatile in meeting certain process or application requirements where more or less drying capacity is required in specific intervals or in specific areas along the width of the dryer.

In the preferred embodiment shown in FIG. 3, two isolated elongated thin recesses (31) are located towards the outside wall of the air distribution plenum (15) to function as thermal insulators between the air passages (19) and the outside of the air distribution plenum (15). By creating a barrier for heat transfer from the air passages (19) to the outside walls of the air distribution system, the elongated thin recesses (31) improve the overall efficiency of the invention and maintain a reduced external surface temperature of the air distribution system (13).

In the preferred embodiment shown in FIGS. 4 and 5, the air distribution system (13) is manufactured with end plates (32) and (33), and gaskets (34) and (35) to effectively seal off the inlet cavity (20), air passages (19) and orifice chambers (25) from the outside of the air distribution system (13). One of the end plates, the heater bulkhead end plate (32) is manufactured with a threaded port (36) to fasten the solid cartridge heater (12), and to effectively prevent pressurized air from escaping at the juncture of the solid cartridge heater (12) and the heater bulkhead end plate (32). The threaded port (36) also provides a convenient means of assembling and/or replacing the solid cartridge heater (12).

By the means described above, the heat source for the dryer unit has been completely integrated within the air distribution system to result in a very compact package. In this preferred embodiment, the end profile of the air distribution system (13) as shown in FIG. 3 is approximately 2" by 2".

The preferred embodiment described herein is capable of operating the solid cartridge heater at high temperatures while simultaneously maintaining substantially lower external surface temperatures given that air is flowing adequately through the air distribution system. This is an important aspect of the invention necessary to reduce risks of operation in solvent laden atmospheres that can spontaneously ignite in the presence of exceedingly high temperatures, and where human interaction can cause bodily injury upon skin contact with the hot surfaces.

The process of evaporative drying of inks, coatings, and paints is not instantaneous. In many cases the maximum narrow web press line speed is limited by the drying capacity of the dryer system. In prior art, it is standard dryer design practice to increase drying capacity by adding additional length to the dryer, thus increasing the residence time of the product being dried within the dryer.

It is the object of this invention to increase drying capacity by: the incremental addition of air distribution systems; redistributing a given number of air distribution systems over a greater dryer length; or a combination of both. It is to be understood that the addition of an air distribution system will also, but not necessarily always, include the addition of an integrated solid cartridge heater.

Figure 6:
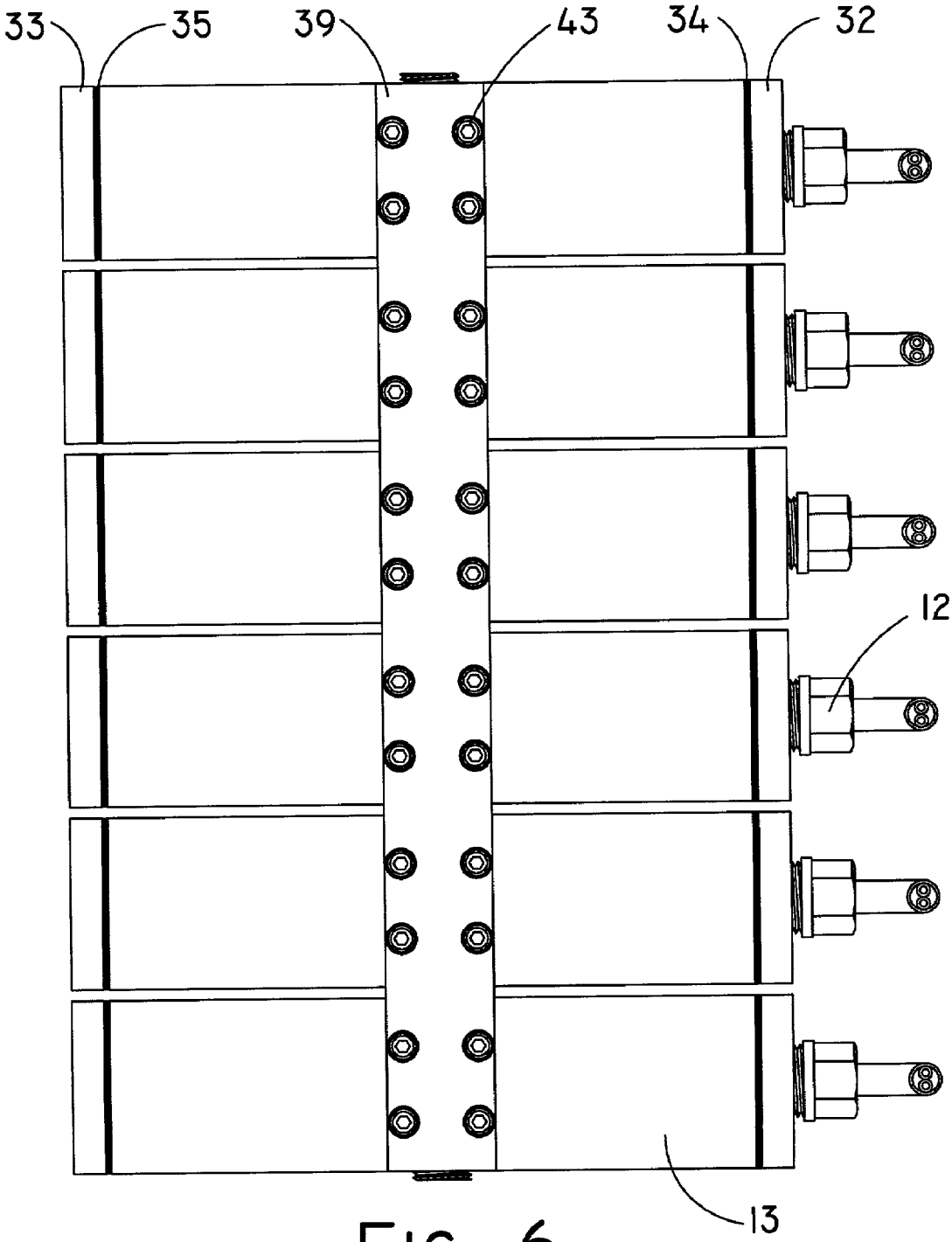
FIG. 6 is a side view of the manifold connected to multiple air distribution systems.
Figure 7:
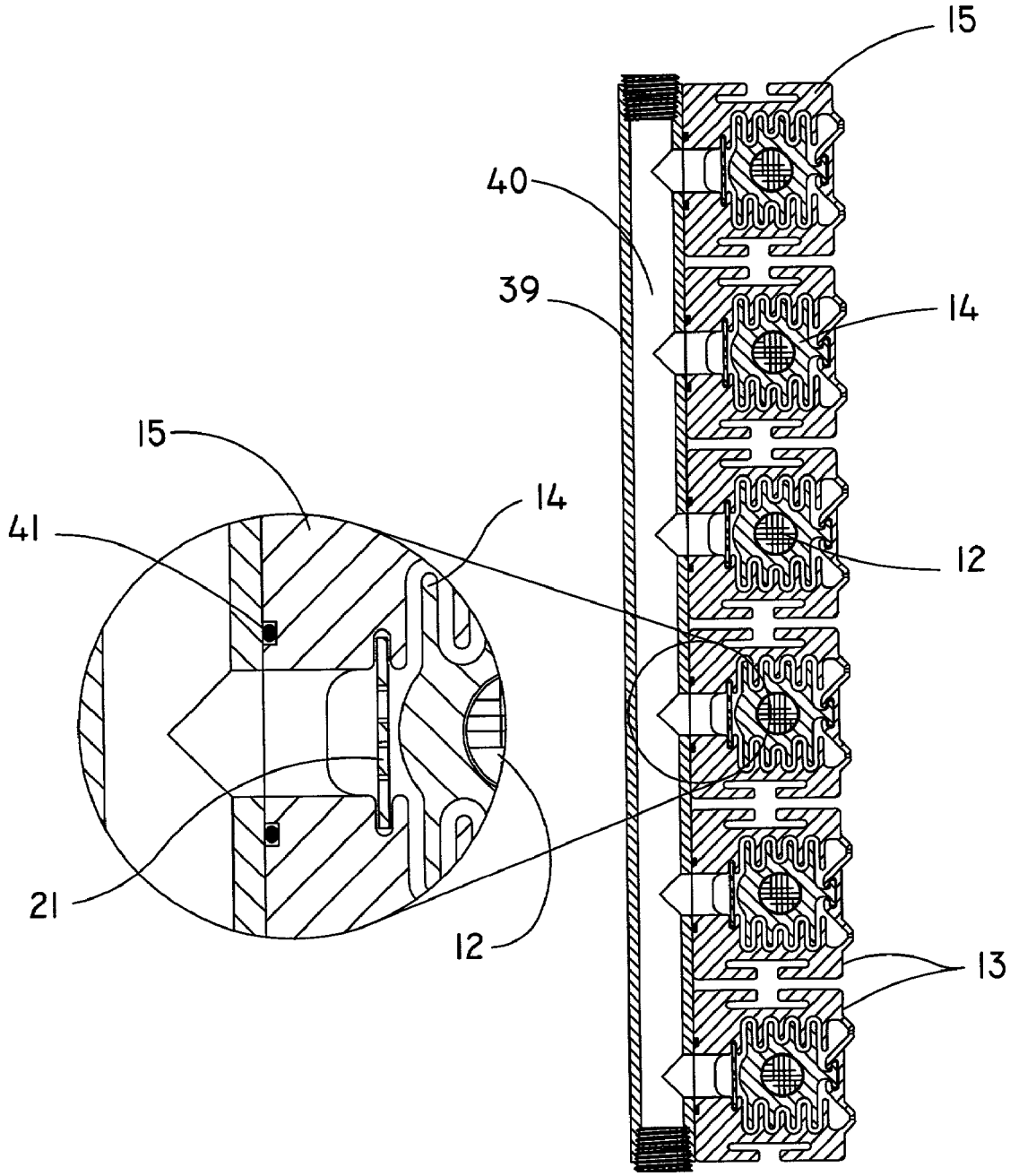
FIG. 7 is a cross-sectional front view of FIG. 6.

FIGS. 6 and 7 illustrates the means by which the invention incorporates a manifold (39) to accommodate multiple air distribution systems (13). The manifold (39) used to couple the air distribution systems has a central cavity (40) in the major axis of the manifold that is sized sufficiently to provide adequate air flow to all coupled air distribution systems (13). The coupling of the air distribution system to the manifold can be achieved through a variety of means including threading, sealant, liquid gasket, crushed-gasket sealing, etc. The preferred arrangement of the preferred embodiment is an o-ring face seal (41) held at the joining surfaces of the manifold (39) and the air distribution system (s) (13). A series of fasteners (43) are used to pre-load the o-ring (41) and to prevent the air distribution system (13) from moving relative to the manifold (39).

The control of the invention involves control of air flow and control of electrical power to the solid cartridge heater. It is the object of the invention to provide a means for operators of the invention to vary both the temperature of the air and flow of the air to dry the product. This variability is necessary because products that can be processed on the narrow web press have broad ranges of thermal yield characteristics, and excessive temperature and airflow conditions can detrimentally affected fragile product structures.

It is the object of the invention to utilize a simple and inexpensive control system for the dryer system.

The volume of air moving through an air conveying medium such as tubing or piping, hereinafter referred to as pipe, is dependent on the geometry of the pipe and the inlet pressure of air moving into the pipe. Variations in inlet pressure, pipe diameter, or pipe length can have a significant affect on the volume of air flowing through the pipe. It is difficult to reliably control the air flow through a pipe system by controlling the pipe system's inlet pressure if the characteristic of the downstream pipe system are unknown or if the pipe geometry can change arbitrarily. This is the inherent difficulty of utilizing a centralized or remotely located flow control system to control flow in a widely distributed air distribution system. Such systems will typically rely on remote sensing of pressure and/or flow and therefore adjust the pipe system's inlet pressure accordingly. It is the nature of the invention to overcome the undesirable effects noted above.

It is foreseen that multiple drying systems will be integrated into a narrow web press, therefore, it is an important object of the invention to provide a repeatable control of air flow by using a common air flow setting for each respective dryer system. It is the object of the invention that by maintaining consistent pipe geometry in each dryer system, air flow through the air distribution system can be reasonably predicted and adequately controlled by controlling the inlet pressure into the dryer system.

Figure 8:
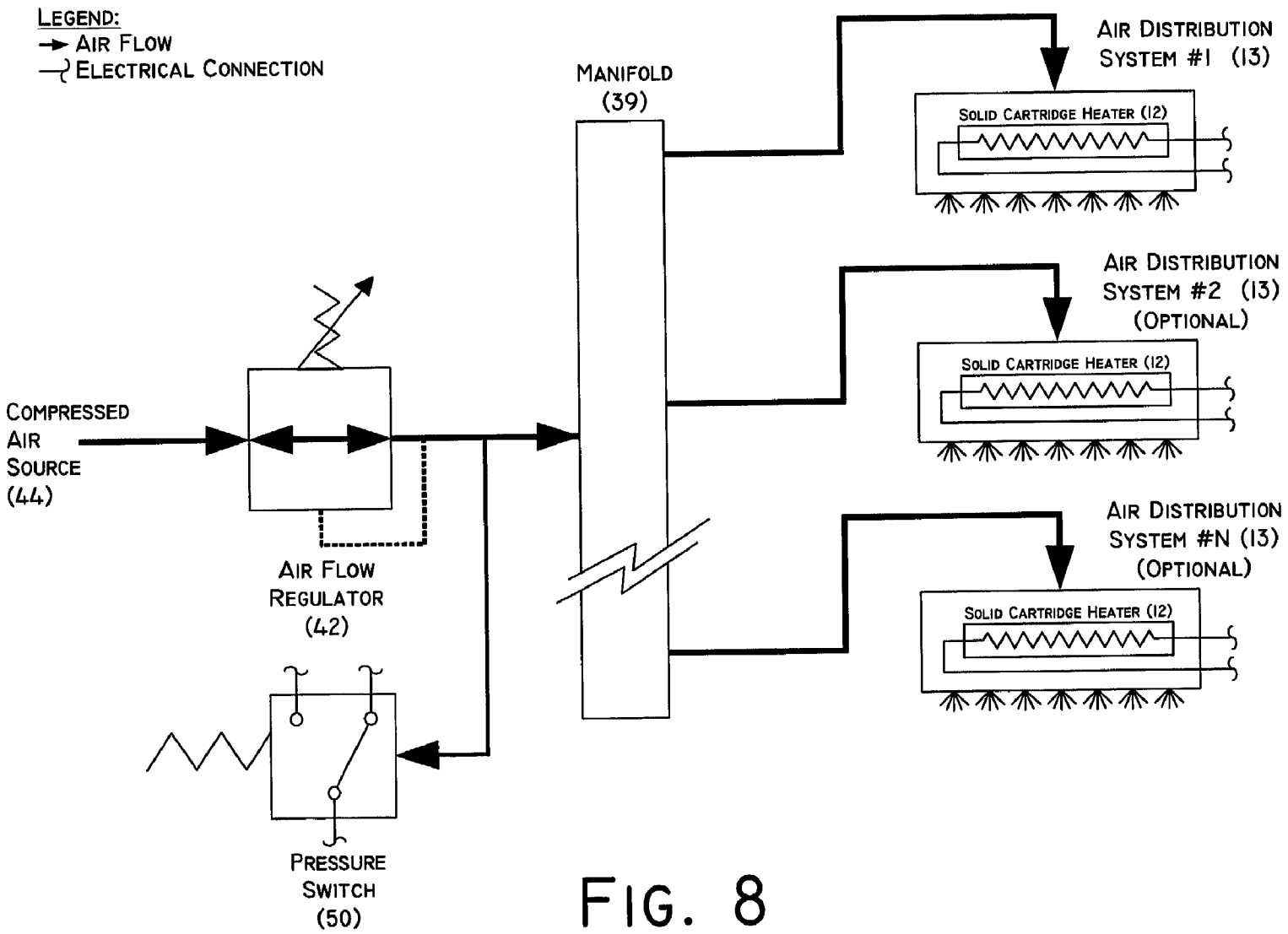
FIG. 8 is a schematic illustration of the air flow control system for the dryer.

As illustrated in FIG. 8, the air flow control system is achieved by the use of an air flow regulator (42) which is a relatively inexpensive, minimally complicated, and commercially available device. Pressurized air (44) is supplied to the air flow regulator (42) which controls the output pressure of the air flow discharging from the air flow regulator (42). The air flow regulator pressure is substantially equivalent to the inlet pressure of the said pipe. The volume of air flowing out of the air flow regulator (42), and thus through the dryer system, can be modified by changing the settings of the air flow regulator (42).

The solid cartridge heater is an electrical device with an electrical resistance, R, that generates thermal power, P, from electrical current, I, by Ohm's Law ($P=I^2R$). Note the electrical current is also related to the electrical voltage, V, by Ohm's Law ($I=V/R$) therefore ($P=V^2/R$). The electrical resistance of the solid cartridge heater is dependent on the operating temperature of the solid cartridge heater typically varying the electrical resistance of the solid cartridge heater by a margin of approximately 10%. The electrical resistance increases with the operating temperature of the solid cartridge heater. For the purpose of the following description, the electrical resistance of the solid cartridge heater will be treated as a constant value, R.

The amount of electrical power consumed by the solid cartridge heater is directly related to the thermal power delivered to the heated air flow that is discharging from the air distribution system. By controlling the electrical power and volume of air flow, the temperature of the air flow can be controlled.

Figure 9:
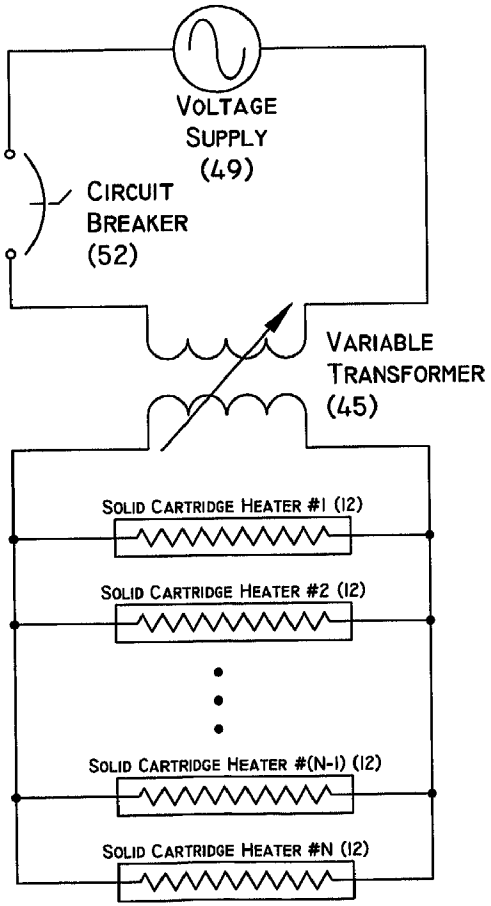
FIG. 9 is a schematic illustration of a variable transformer electrical control system for the dryer.

A relatively simple scheme for controlling the power to the solid cartridge heater is to control the voltage to the solid cartridge heater. FIG. 9 illustrates a voltage controller based on a mechanically adjustable variable transformer, hereinafter referred to as the variable transformer (45). The variable transformer (45) is a commercially available device.

The variable transformer (45) allows simple adjustment of the output coil of the variable transformer (45) thus effecting the voltage output ratio of the variable transformer (45). The variable transformer (45) is typically manually adjusted to supply a constant output voltage at the desired voltage amplitude. The output voltage from the variable transformer (45) serves as the supply voltage for the solid cartridge heater (12). In this fashion a constant supply voltage is applied to the solid cartridge heater (12). Also as shown in FIG. 9 multiple solid cartridge heaters (12) can be connected in parallel across the supply voltage.

Adjusting the output voltage to one-half of the maximum output voltage will produce one-fourth the power produced at the maximum output voltage as can be determined from Ohm's Law ($\frac{1}{4}*P_{max}=((\frac{1}{2})*V_{max})^2/R$). The variable transformer is an elegant means of adjusting the output power of the heater and the respective drying capacity of the dryer.

The primary advantage of using the variable transformer control system is the low cost and low complexity.

A further advantage of using the variable transformer control system is the ability to energize the solid cartridge heater(s) at a fraction of their rated power continuously, even without air flow through the air distribution system. This provides a convenient and more economical means of preheating the dryers by avoiding the consumption of pressurized air.

In using the variable transformer control system as the primary electrical control system, the variable transformer control system lacks a closed-loop temperature control. At a constant output voltage setting a change in the air flow volume will affect the air flow discharge temperature. Thus without an independent temperature sensor monitoring the dryer operating temperature, the operator of this dryer will not have an accurate measure of the effective drying temperature. Furthermore, even with a temperature sensor feedback, a mechanically adjusted variable transformer would be very complex to configure to automatically control to a desired dryer operating temperature.

In practical operation, depending on the product, process, and application, the air flow settings and the variable transformer settings can be determined through trial and error, and subsequently used as reference settings to reliably reproduce the same dryer conditions in the future on any of the variable transformer controlled dryers on the narrow web press.

The variable transformer control system provides an effective means for operating the dryer, however the preferred dryer system includes a means to control to a desired dryer operating temperature since an acceptable level of drying is more readily correlated to a dryer temperature.

Figure 10:
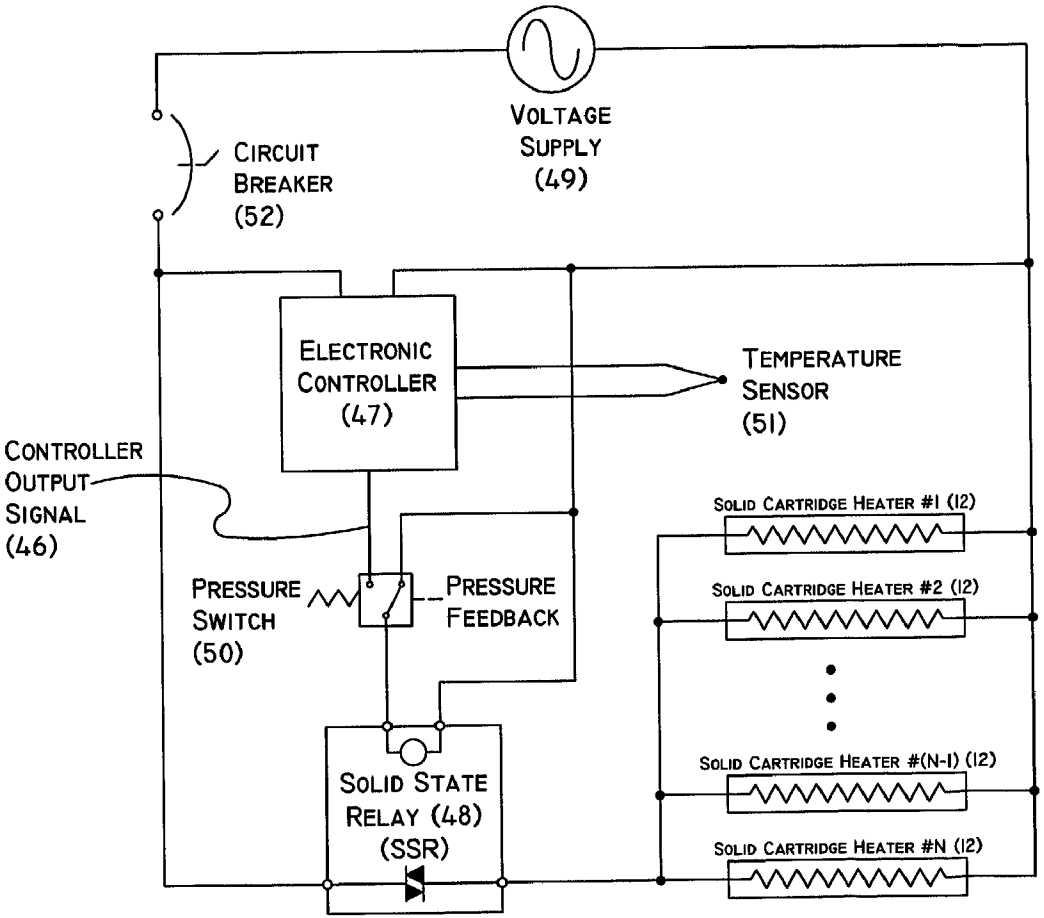
FIG. 10 is a schematic illustration of an electronic control system for the dryer.

The preferred electrical control system illustrated in FIG. 10 uses an electronic controller (47) to modulate the supply voltage (49) to the solid cartridge heater(s) (12) between an energized and de-energized state. In this scheme, the supply voltage (49) to the solid cartridge heater(s) (12) is modulated at either the maximum supply voltage setting or none at all. The amount of thermal power delivered by the dryer system is related to the percentage of time the dryer is energized.

The electronic controller (47) is a commercially available device that can be obtained in a variety of configurations and with a variety of features. In this preferred embodiment the controller output signal (46) from the electronic controller is a low voltage, low power signal incapable of energizing the solid cartridge heater(s) (12) directly. However, this low voltage, low power controller output signal (46) can be used to activate a secondary device such as a mechanical relay or solid state relay to energize the supply voltage to the solid cartridge heater (12). In this preferred embodiment as shown in FIG. 10 a solid state relay (48) is used to energize the supply voltage (49) to the solid cartridge heater(s) (12) when the solid state relay (48) is commanded by the electronic controller (47) via the controller output signal (46).

The electronic controller (47) utilizes an external temperature measurement and compares it to a pre-set temperature as established by the operator of the narrow web press. The pre-set temperature settings depend on the product, process, and application. If the external temperature measurement is lower than the pre-set temperature, the electronic controller (47) commands the solid state relay (48) to energize the supply voltage (49) to the solid cartridge heater(s) (12). If the external temperature measurement is higher than the pre-set temperature, the electronic controller (47) commands the solid state relay (48) to de-energize the supply voltage (49) to the solid cartridge heater(s) (12).

An inherent problem of this scheme is that the electronic controller continues to command an energized state of the supply voltage whenever the external temperature measurement is below the pre-set temperature. This condition will exist when the air flow to the dryer system is shut-off either intentionally or mistakenly. Since this control scheme will only supply the maximum supply voltage when energized, the above condition places the solid cartridge heater(s) at a severe risk of failure from reaching excessive temperatures.

A solution to this problem is the integration of an electromechanical pressure switch or pressure transducer to monitor the pressure and thus flow of air through the air distribution system. The electro-mechanical pressure switches and pressure transducers are commercially available devices. In this preferred embodiment, an electro-mechanical pressure switch (50) monitors the air pressure of the air distribution system and allows the controller output signal (46) to activate the solid state relay (48) as long as the system is operating with adequate air pressure. Without adequate air pressure the electro-mechanical pressure switch (50) will electrically ground the solid state relay (48) and insure the supply voltage (49) is not energized to the solid cartridge heater(s) (12).

A temperature sensor (51) is located to monitor the effective temperature of the dryer system, and to provide the external temperature measurement signal to the electronic controller (47). The temperature sensor (51) can monitor the temperature of: the air distribution system's component; the air within the air distribution system; the air discharging from the air distribution system; a component that is in contact with the product being dried; etc. Depending on the location of the measurement point, the control response of the system and the maximum achievable temperature can vary greatly. To overcome this the operational control gains of an electronic temperature controller can be adjusted to establish acceptable system controllability.

A circuit breaker (52) is incorporated as a switch and safety device for the control system of either the variable transformer control system or the electronic control system as shown in FIGS. 9 and 10 respectively.

The above text has described in detail the three basic subsystems of the forced air dryer including the air heating and distribution system, the air flow control system, and the electrical power control system. It is an object of the invention to combine the three subsystems into a singular compact unit for ease of integration with the web and into the narrow web press.

It is an object of this invention to house all of the air flow and electrical controlling components of the dryer into a control box enclosure to shield the components from the environment. These components include the electronic temperature controller, air flow regulator, pressure switch, solid state relay, and circuit breaker, all of which have already been described above.

Enclosing the air flow and electrical control components is an important aspect of the invention since dryers will typically reside in hazardous environments caused by flammable solvent vapors evaporated from the inks. When the dryer system is operated in a hazardous environment, the control box enclosure can be gasket sealed and lightly pressurized to achieve a purged environment within the control box enclosure allowing the safe operation of the electrical components. The lightly pressurized air is provided as a natural by-product of the relieving pressure regulator under normal operating conditions.

Enclosing the air flow and electrical control components is also an important aspect of the invention in an effort to shield all of the controlling components from incidental debris generated by normal operation of the printing press. The debris includes ink spills, cleaning solvent, lubrication, etc.

It is also an object of this invention to connect and seal air flow lines and electrical lines to and from the control box enclosure such that the control box enclosure is sealed and capable of being lightly pressurized.

It is an object of the invention to locate the operational controls such that they are accessible to operators of the narrow web press.

It is an object of this invention to enclose the solid heater cartridge within the air distribution system as to result in acceptably low external surface temperatures of the air distribution system. This combined with the proper accommodation of air flow lines and electrical lines permits the dryer to reside in a hazardous environment.

The air distribution system must be designed to accommodate the maximum web width of the printing press and to provide the desired residence time of the dryer. This is accomplished by appropriate layout of the manifold and air distribution system(s) within the dryer as described in detail earlier in the patent.

It is well known that drying capacity decreases as the distance between the web and the discharge orifices of the dryer increase. It is also well known that uniform drying will result when the web is held uniformly and at a constant distance from the dryer across both the length and width of the dryer, given that the discharging air flow and temperature are uniform across the same. Therefore, it is an object of the invention to hold the web in the dryer at a close and even distance from the discharging air to achieve proper drying.

In consideration of retrofitting the dryer onto a narrow web press, the integration of the web support into the dryer will minimize press modifications and dryer design variations with respect to web handling as the web passes through the dryer. The web support that is incorporated into the dryer must provide an even support across both the width and the length of the dryer, such that the web is prevented from being deflected when subjected to the discharging air from the air distribution system(s). It is also an object of the invention that the web support is a simple device in that it provides the operator easy access for web threading and dryer cleaning It is an object of this invention to house all components and subsystems of the dryer into a single compact unit that can be mounted in an area where space is limited.

It is also an object of the invention to minimize the installation time of the dryer unit. By including provisions into the dryer design, only mounting the dryer to the press and connecting to the electrical power and compressed air sources to the dryer will be required for installation.

The solution to the objectives as outlined above are shown in FIGS. 11, 12, 13, 14, and 15 with the following accompanying detailed description:

It is an object of the invention to house all principal components of the control system including the air flow regulator (42), pressure switch (50), electronic controller (47), solid state relay (48), and circuit breaker (52) into a dedicated control box enclosure (53). It is also an object of this invention to include the control box enclosure (53), manifold (39), air distribution systems (13), and all interconnecting components inside the dryer enclosure (62).

Figure 12:
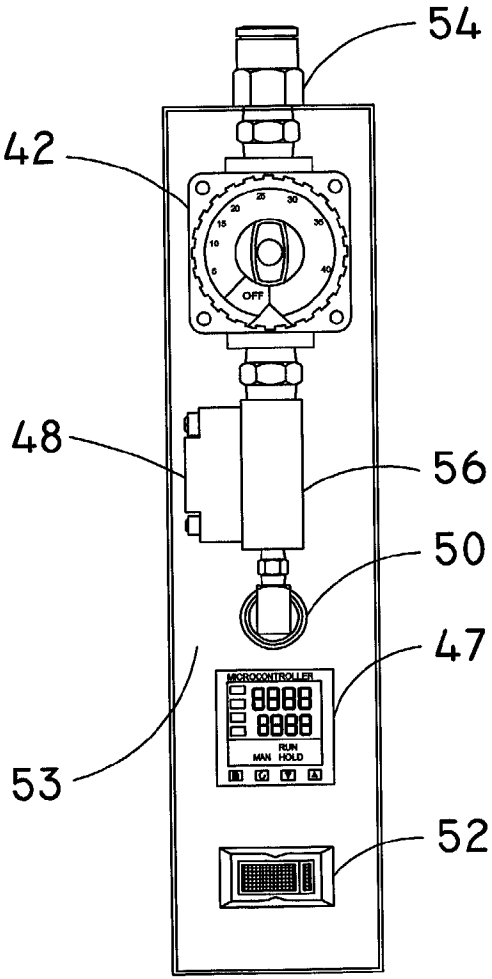
FIG. 12 is a front view of FIG. 11.
Figure 11:
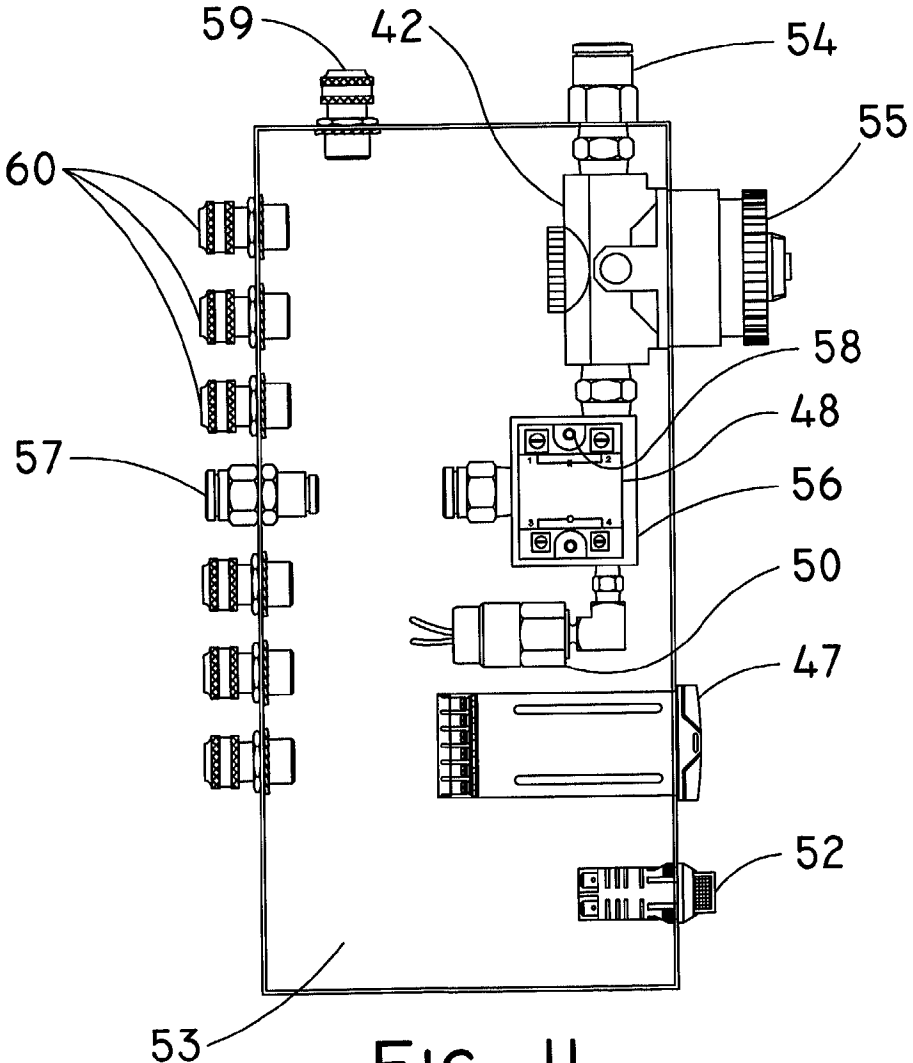
FIG. 11 is a side view of the assembled control box enclosure.

As illustrated in FIGS. 11 and 12, an external compressed air supply line is connected to the dryer through a single air supply port (54) on the control box enclosure (53). The air supply port (54) can be achieved by a number of means including a quick air disconnect, a push-to-connect fitting, a hose barb fitting, threaded pipe fitting, etc. The preferred means is to use a push-to-connect fitting, which provides a convenient and tool-less means of connecting and disconnecting the dryer from the external pressurized air supply line.

The air supply port (54), which is rigidly joined to the air flow regulator (42), passes the supply air through the wall of the control box enclosure (53) and into the inlet port of the air flow regulator (42).

The air flow regulator (42) must be accessible for manual adjustment by the press operator during normal operation of the dryer. The air flow regulator (42) is mounted inside the control box enclosure (53) such that the control dial (55) of the air flow regulator (42) passes through an opening in the control box enclosure (53) thus allowing convenient manual adjustment of the air flow in the dryer.

Air flow exiting the outlet port of the air flow regulator (42) passes through a specially designed air flow block (56) which is then connected to an air outlet port (57) mounted to the wall of the control box enclosure (53). The air flow block (56) is connected to the air outlet port (57) by tubing. Outside of the control box enclosure, the air outlet port (57) is connected to the inlet port on the manifold (39) by tubing.

The air flow block (56) also provides an air pressure sensing port for the electro-mechanical pressure switch (50). The air flow block (56) also provides holes (58) for mounting the solid state relay (48) firmly against the air flow block (56). This firm surface contact between the solid state relay (48) and the air flow block (56) provides a means for heat generated by the solid state relay (48) to be transferred to air passing through the air flow block (56). The solid state relay (48) must shed this heat in order to operate safely and reliably, and the transfer of thermal energy to the air is an efficient use of the available thermal energy for the purpose of drying.

The electronic controller (47) must be accessible for manual adjustment by the press operator during normal operation of the dryer. The electronic controller (47) is mounted inside the control box enclosure (53) such that the temperature display and temperature controller keys are presented outside the control box enclosure (53) thus allowing convenient manual adjustment of the dryer temperature setting.

The circuit breaker (52) operates as an electrical safety device and as a switch for energizing the control system of the dryer. The circuit breaker (52) is mounted such that the switch can be manually switched from outside the dryer.

The electrical power supply to the dryer is provided by an electrical cable that penetrates the wall of the control box enclosure (53) utilizing a sealed electrical bushing (59). The sealed electrical bushing (59) is required to have the capability to lightly pressurize the internal volume of the control box enclosure (53).

The electrical power supply is connected to the circuit breaker (52) and then distributed internally to the electronic controller (47) and the solid state relay (48). The control signal from the electronic controller (47) is connected through the pressure switch (50) and then to the solid state relay (48). The pressure switch (50) is mounted to the pressure sensing port of the air flow block (56). When air flows through the air flow block (56), air pressure activates the pressure switch (50) and closes the electrical signal path between the electronic controller (47) and the solid state relay (48).

The electrical power is switched on by the solid state relay (48) and then made available for connection to the solid cartridge heaters (12). The controlled electrical power output to each of the solid cartridge heaters (12) is achieved by utilizing a sealed electrical bushing (60) for each of the solid cartridge heater power cables (61). The heater manufacturer seals the power cables (61) to the end of the solid cartridge heaters (12) as part of the standard design.

The temperature sensor feedback signal cable also passes through the control box enclosure wall utilizing a sealed electrical bushing (not shown). The temperature sensor feedback signal is connected to the electronic controller (47).

Figure 13:
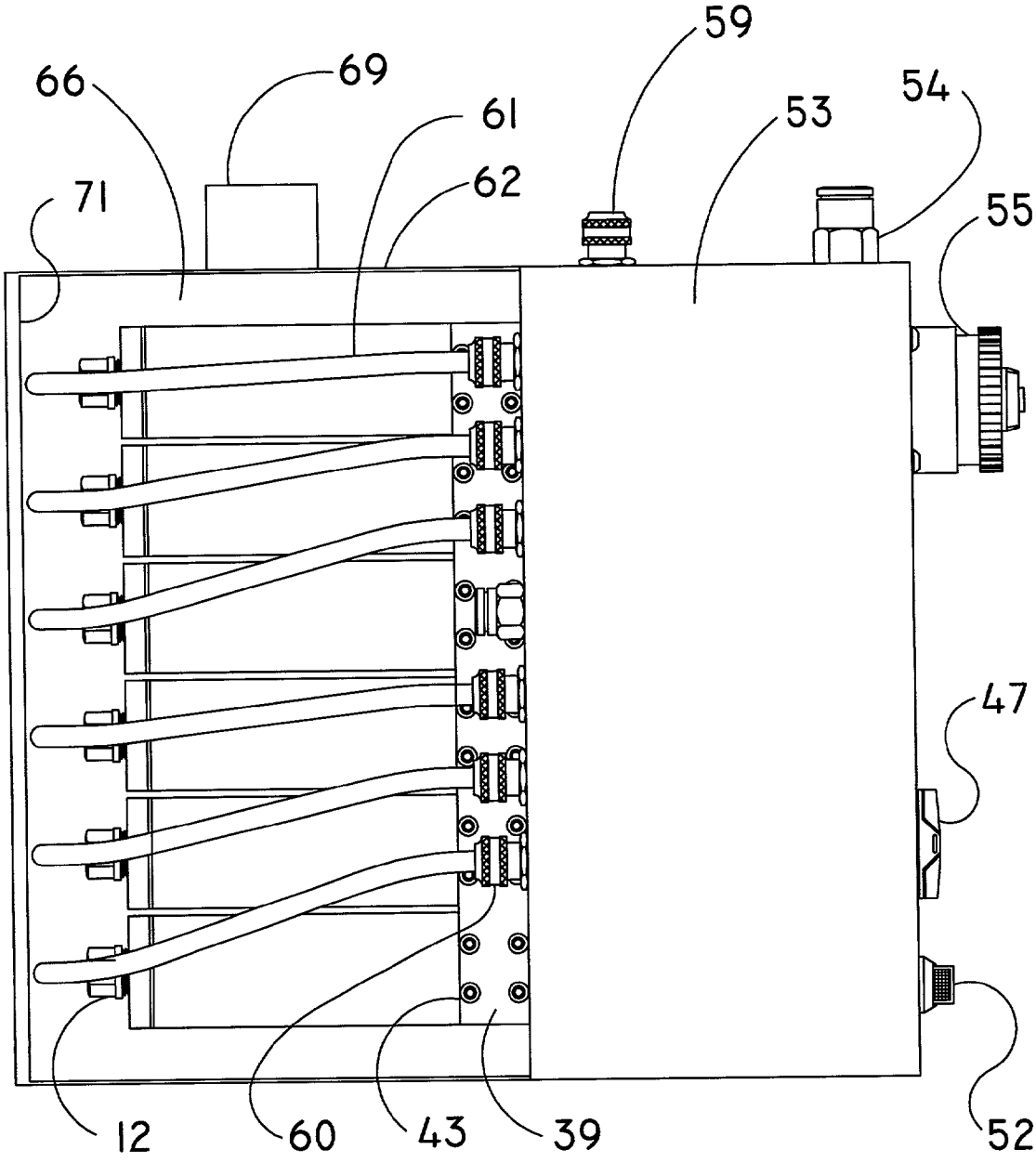
FIG. 13 is a side view of the assembled dryer.
Figure 14:
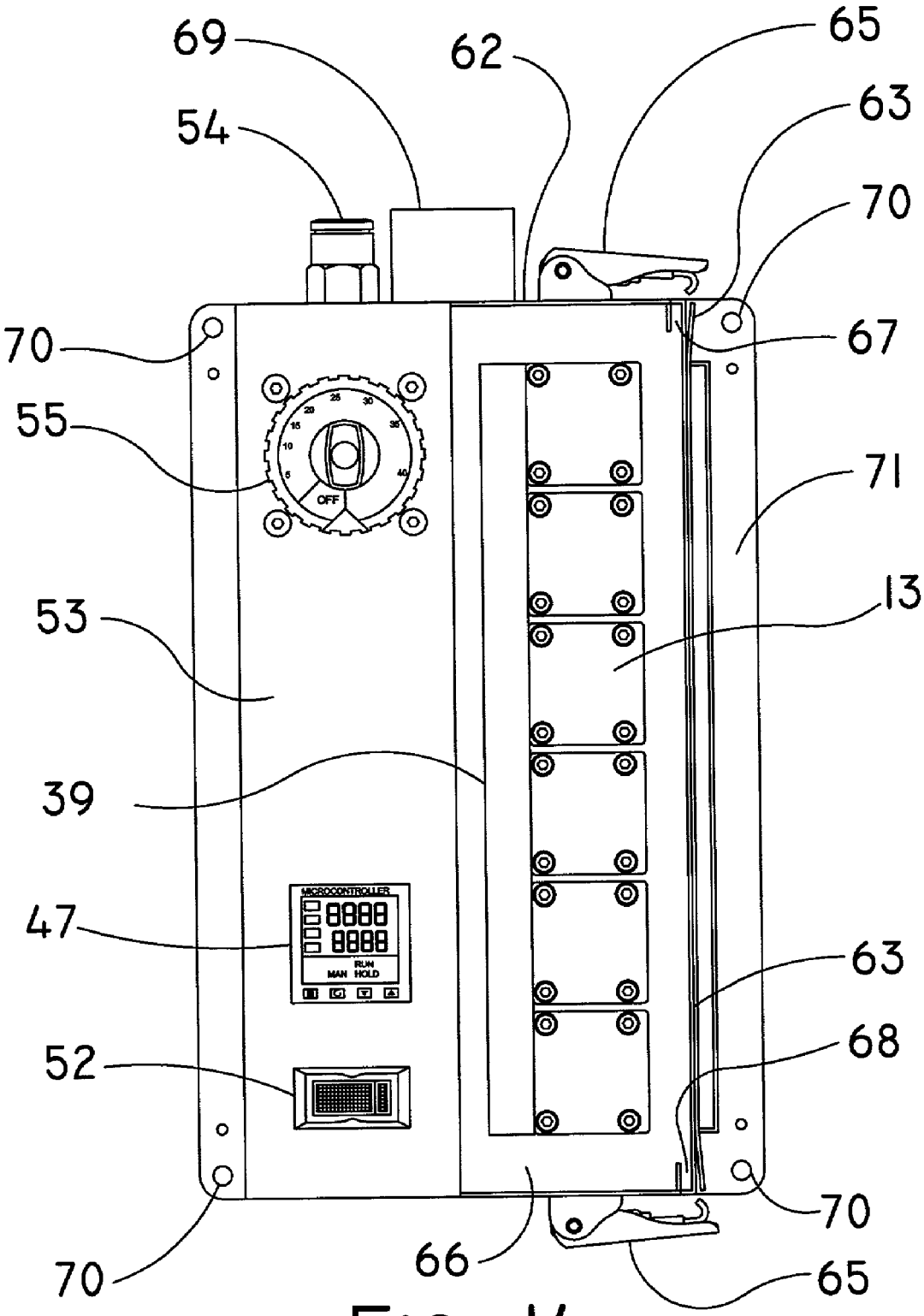
FIG. 14 is a front view of FIG. 13.

As illustrated in FIGS. 13 and 14, the control box enclosure (53) is mounted to the dryer enclosure (62). The manifold (39) and air distribution system(s) assembly is mounted to the dryer enclosure (62)

Figure 15:
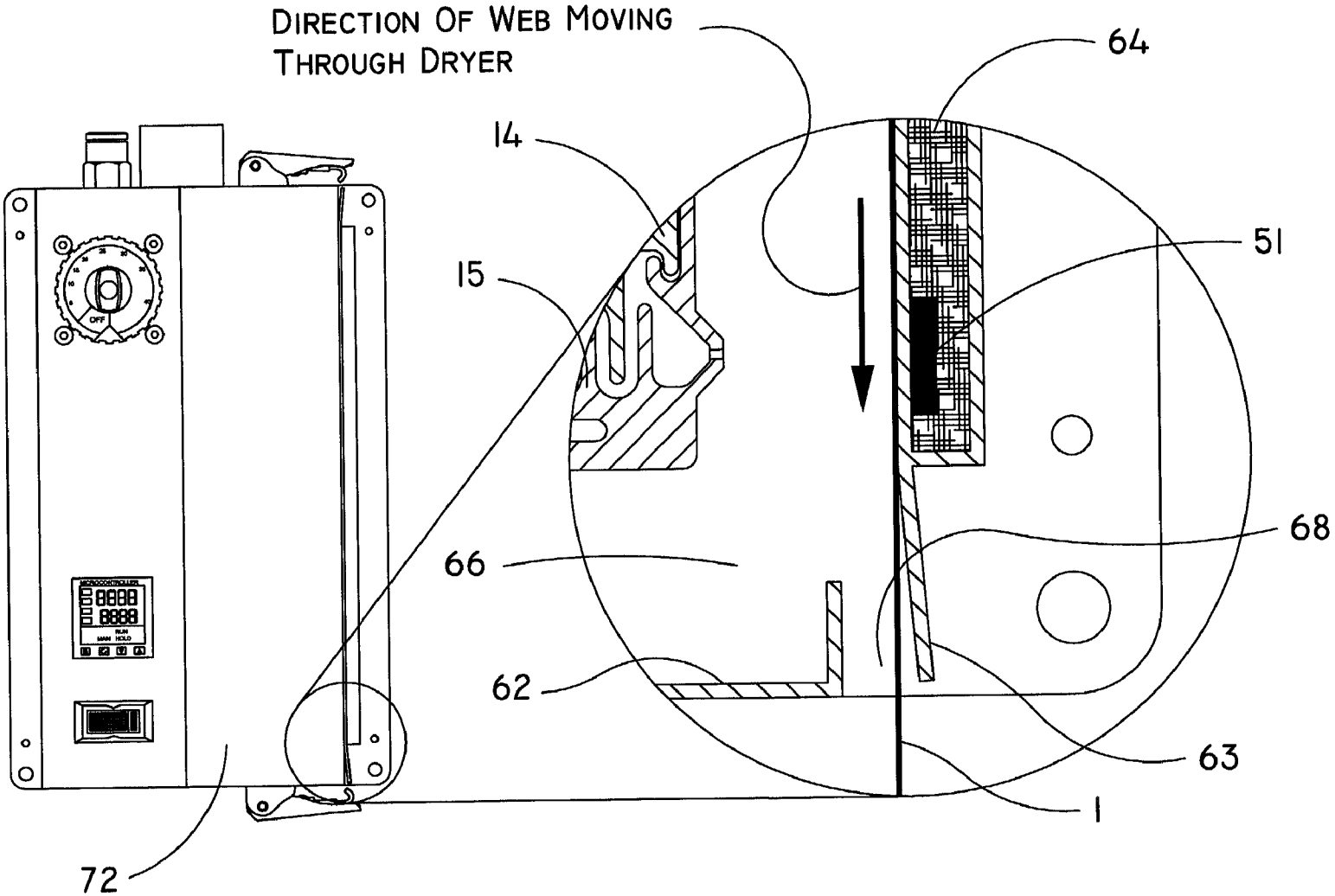
FIG. 15 is a sectional view of the temperature monitoring means for the dryer.

As shown in FIG. 15, the solution for supporting the web is accomplished with a slide plate (63). The slide plate (63) is of a sheet metal construction, and is attached to back side of the dryer enclosure (62) by use of a hinge allowing the slide plate (63) to function as a door. Mechanical latches (65) are located towards the front-side of the dryer enclosure providing a convenient means for the press operator to open the slide plate for manual threading of the web through the dryer during machine set up, or for maintenance access to clean the air distribution systems (13). The slide plate (63), hinge, latches (65) and supporting structure of the enclosure are designed to insure that when closed, the slide plate (63) provides a firm web support that is positioned approximately ½" from the discharge orifices of the air distribution system. The mechanisms described above also insure that the location of the slide plate (63) relative to the air distribution systems (13) is held evenly across the length and width of the dryer.

Normal operation of the dryer discharges significant volumes of air into the area where the product is being dried. As the product dries, significant volumes of solvent vapor are evaporated into the area where the product is being dried. It is the object of the invention to remove the mixture of discharged air and evaporated solvent vapors. This is achieved by enclosing the area where the product is being dried by a plenum (66) and then exhausting the internal volume of the plenum (66).

The dryer enclosure (62) and control box enclosure (53) form five of the six sides of the box type construction of the said plenum. The slide plate (63) and web provide the sixth side of the plenum (66). It is an object of the invention to provide minimal slot openings (67) and (68) for the web to enter and exit the plenum (66) respectively. An external exhaust system provides the light suction necessary to draw the air and solvent vapors from inside the plenum, and is connected to an exhaust port (69) located on the dryer enclosure to remove air and solvent vapors from inside the plenum (66).

Mounting holes (70) for attaching the dryer to the narrow web press structure are provided in the back plate (71) of the dryer enclosure (62) of the dryer.

As briefly discussed earlier in the patent, dryer systems monitor and control to a temperature of an element of the dryer system. It is most desirable to measure the actual product temperature of the product being dried since the product temperature is indicative of the level of drying that has been achieved. Historically, the means of measuring the actual product temperature has been very difficult to implement.

In lieu of measuring the temperature of the product being dried, a common practice has been to measure the temperature of the forced air of the dryer with the general assumption that the product achieves the substantially equivalent temperature of the forced air. Depending on the product, process, and application this assumption may be invalid.

It is an object of the invention to provide a means that will more accurately represent the actual temperature of the product being dried. FIG. 15 illustrates the preferred solution to this design objective.

A commercially available temperature sensor (51) is mounted onto the backside of the metallic slide plate (63), near the end of the metallic slide plate (63) where the web (1) exits the dryer (72). The temperature of the metallic slide plate (63) in this area will essentially stabilize at the temperature of the web due to the close and constant proximity with the heated web (1).

Additional heat loads in the slide plate (63) may be generated due to the friction of the web (1) sliding over the slide plate (63). The additional heat loads from friction are considered negligible due to the low contact force of the web (1) against the slide plate (63). To minimize any other interference from the environment to the temperature sensor (51), insulation (64) is added onto the backside of the slide plate (63) and the temperature sensor (51). The thermocouple wire leads are then routed back to the input of the dryer's temperature controller.

The Foregoing dryer system includes the following features:

1. All components and subsystems of the dryer are combined into a single unit that can be mounted in an area where space is limited.

2. Provisions have been made to minimize the installation time of the dryer unit so that only mounting the dryer to the press and connecting the dryer to the electrical power and compressed air sources will be required for installation.

3. An air distribution system that maintains cool external surface temperatures while simultaneously integrating the heat source directly into the air distribution system at the immediate vicinity of the discharging forced air. The external surface temperature of the air distribution system is maintained at sufficiently low temperatures such that the air distribution system can operate in solvent laden environments without the risk of spontaneously igniting the flammable air and solvent vapor mixture.

4. A control system for both air flow and air temperature that is integrated directly with the dryer system so as to provide a convenient means for the operator to make adjustments to either the air flow setting or temperature setting or both at the dryer location. The integration of the control system into the dryer eliminates the need for the operator to make the said adjustment(s) from an inconvenient remote location.

5. The heat source is mounted within the air distribution plenum providing the most efficient means of utilizing the power from the heat source for the purpose of drying. The air is heated just before it is dispersed through the air release orifices onto the web. By combining the heat plant into the air distribution plenum, the unit is very compact, requires fewer parts, and is less expensive to manufacture.

6. When the dryer system is operated in a hazardous environment, the control box enclosure can be gasket sealed and lightly pressurized to achieve a purged environment within the control box enclosure allowing the safe operation of the electrical components. The lightly pressurized air is provided as a natural by-product of the relieving pressure regulator under normal operating conditions.

7. A slide plate is used to provide even support to the web as the web passes through the dryer. The slide plate has a hinge and latch configuration that allows the press operator a convenient means to rock the slide plate back out of the way for manual threading of the web through the dryer during machine set up, or for maintenance access to clean the air distribution assemblies.

8. Solid cartridge heaters are available with various power levels in the same cylindrical geometry. A conveniently located bulkhead plate with a threaded port is used to mount the solid cartridge heater in the air distribution system. This provides the press operator with a means to readily change out solid cartridge heaters with different power levels for different processes and application.

9. The effective drying temperature of the dryer is measured using a temperature sensor that is mounted to a metallic slide plate that is in contact with the web. The temperature of the metallic slide plate essentially stabilizes at the temperature of the web, due to the contact with the web, and will provide the operator with a more accurate measurement of the effective drying temperature of the process. This can greatly reduce set up time and maintain quality on repeat jobs.

10. Solid cartridge heaters are available with variable power densities along the axial length of the solid cartridge heater. The variable power densities can be used to create hot or cold spots in specific intervals or in specific areas along the width of the dryer to counteract uneven flow patterns past the solid cartridge heater or to meet specific process or application requirements.

The particularly novel features of the invention can be summarized as:

1. The preferred embodiment utilizes a solid heating cartridge within a specially designed air distribution system to raise the temperature of the forced air just before it discharges.

2. A self-contained forced hot air drying unit for the printing, painting and coating industries that fully integrates the air handling equipment, heat plant, air flow control and air temperature control into a single compact package.

3. Effective drying temperature is monitored by measuring the web temperature.

The invention claimed is:

1. An air distribution system for a forced hot air drying unit for drying inks, paints or coatings comprising:

a housing having at least one orifice chamber, an inlet cavity, a baffle, air passages, and a series of orifices allowing air to pass from said orifice chamber to the exterior of said housing of said air distribution system, said baffle arranged to distribute air from said inlet cavity to said air passages, said series of orifices sized to provide an air impingement on a substrate to be dried;

an internal construction capable of accepting an electrical heater which allows heat to be efficiently conveyed from said electrical heater through said internal construction to the air as the air passes from said baffle to said orifices; and an electrical heater mounted within said internal construction of said housing of said air distribution system.

2. The air distribution system of claim 1 in which said heater comprises a solid cartridge heater that comprises a selectable material composition, diameter, length and wattage.

3. An air distribution system according to claim 1, wherein said baffle comprises a plurality of baffle orifices spaced apart along a length thereof.

4. An air distribution system according to claim 3, wherein said baffle orifices are variably sized to ensure an even air flow along the length of the air passages.

5. An air distribution system according to claim 4, wherein said electrical heater comprises a solid cartridge heater.

6. An air distribution system according to claim 1, wherein said electrical heater comprises a solid cartridge heater.

7. An air distribution system according to claim 1, wherein said internal construction comprises a serpentine structure that defines said air passages and provides an extended heat transfer surface between said heater and said air passages.

8. An air distribution system according to claim 1, wherein said baffle comprises a plurality of baffle orifices spaced apart along a length thereof; wherein said electrical heater comprises a solid cartridge heater; wherein said internal construction comprises a serpentine structure that defines said air passages and provides an extended heat transfer surface between said heater and said air passages.

9. An air distribution system according to claim 8, wherein said solid cartridge heater is elongated along an axis and said air passages are arranged such that a flow of air through said air passages is in a substantially perpendicular direction to said axis.

10. A forced hot air drying unit for drying inks, paints or coatings where all dryer components are located in a single enclosure comprising:

a means for receiving pressurized air;

a means for receiving electrical power;

a plurality of air distribution systems mounted within said single enclosure, wherein each distribution system is connected to said means for receiving pressurized air and said means for receiving electrical power, wherein each distribution system receives, heats, and disperses said pressurized air;

a means of controlling the flow of said pressurized air passing through said air distribution systems, including an air flow regulator; and a means of controlling the temperature of the air passing through said air distribution systems, including a modulating power electronic temperature controller.

11. A forced hot air drying unit according to claim 10, wherein each said air distribution system comprises an elongated housing having an air inlet, an air outlet in the form of a plurality of orifices oriented for directing air onto a substrate to be dried, and at least one air passage between said air inlet and said air outlet; and a solid cartridge electrical heater within said housing.

12. A forced hot air drying unit according to claim 11, comprising a heat exchanger having a central channel for receiving said solid cartridge heater and an extended heat transfer surface comprising fins that in part define said at least one air passage.

13. A forced hot air drying unit according to claim 11, comprising an extended heat transfer surface between said solid cartridge heater and said at least one air passage, and wherein said housing air inlets of said plurality of air distribution systems are connected by a manifold within said single enclosure, said single enclosure having a single air inlet connection connected to said manifold.

14. An air distribution system for a forced hot air drying unit for drying inks, paints or coatings comprising:

a housing with an air inlet port to allow air to enter said housing, an internal cavity, and a plurality of orifices formed through a wall of said housing to allow air to pass from said internal cavity to the exterior of said housing;

a heater mounted within said internal cavity of said housing; and a baffle within said internal cavity for distributing air along the length of said heater.

15. An air distribution system according to claim 14, wherein said baffle comprises a plurality of baffle orifices spaced apart along a length thereof.

16. An air distribution system according to claim 15, wherein said baffle orifices are variably sized to ensure an even air flow along the length of the air passages.

17. An air distribution system according to claim 14, wherein said heater comprises a solid cartridge electrical heater.

18. An air distribution system according to claim 14, wherein said internal cavity forms a serpentine structure that defines at least one air passage between said inlet port and said orifices and provides an extended heat transfer surface between said heater and said air passage.

19. A means of monitoring the effective temperature of a forced hot air drying unit for drying inks, paints or coatings comprising:

a thermocouple mounted to a thermal conducting slide plate in contact with the materials being dried;

the thermocouple mounted in a location where the material being dried has already been exposed to the majority of the resident time of the drying unit;

the thermocouple being capable of attaining the temperature of the material being dried.

* * * * *